United States Patent [19]

Cheng

[11] Patent Number: 4,728,104

[45] Date of Patent: Mar. 1, 1988

[54] TOY SLOT RACING VEHICLE SETS

[75] Inventor: Chi F. Cheng, Hong Kong, Hong Kong

[73] Assignee: Artin Industrial Company Limited, Kowloon, Hong Kong

[21] Appl. No.: 938,485

[22] Filed: Dec. 5, 1986

[30] Foreign Application Priority Data

Dec. 9, 1985 [GB] United Kingdom ..... 8530282

[51] Int. Cl.[4] ..... A63F 9/14

[52] U.S. Cl. ..... 273/86 B; 104/305; 446/455

[58] Field of Search ..... 273/86 B; 104/295, 304, 104/305; 446/454, 455

[56] References Cited

U.S. PATENT DOCUMENTS

| | | | |
|---|---|---|---|
| 737,257 | 8/1903 | Majno | 273/86 B UX |
| 1,999,052 | 4/1935 | Kennedy | 273/86 B |
| 3,467,311 | 9/1969 | Ernst | 273/86 B |
| 4,247,108 | 1/1981 | Tilbor et al. | 273/86 B |

*Primary Examiner*—Anton O. Oechsle

*Attorney, Agent, or Firm*—Townsend & Townsend

[57] ABSTRACT

A toy slot racing vehicle set including a track with one or more slots for electrically-driven toy vehicles guided by a downward projection extending into a slot, the vehicle picking up electrical power from a pair of conductors inset into the track and electrical power supply means for those conductors which include at least one hand-held controller having means to vary the electrical power applied across the conductor so as in turn to vary the speed of the toy vehicle, and further comprising switch means on the hand-held controller for providing a short circuit between the two conductors whereby when the switch means are operated and the two conductors short-circuited, the electrical motor in the vehicle will act in a regenerative sense producing an electrical current which is short-circuited and thereby provides braking for the vehicle.

5 Claims, 3 Drawing Figures

TOY SLOT RACING VEHICLE SETS

This invention relates to toy slot racing vehicle sets and in particular to the controllers and power units for such sets.

BACKGROUND TO THE INVENTION

Toy slot racing car sets are well known and generally comprise a track having one or more slots in the track engaged by a downwardly projecting pin on the vehicle for guiding that electrically-powered vehicle such as a racing car around the track. The car or other vehicle picks up electrical current from a pair spaced conductors set flush into the track and the speed of the car is controlled by the user who varies the voltage supplied to the vehicle across the two conductors. This is usually achieved by a hand-held controller which has a resiliently mounted lever or the like controlling the voltage output by means of an adjustable resistor.

Such sets usually have more than one slot in the track so that a number of vehicles can follow the same overall track and a number of players can therefore control their own individual cars and so race one another around the track.

In existing sets of this type, we are not aware of any provision being made to enable braking of the car as it approaches a bend. Thus, the car is generally slowed down solely by reducing the electrical power to a low level or zero so that the car will then coast into the corner and generally slow down solely because of friction and the like.

It is therefore an object of the present invention to improve the versatility of such toy sets by providing a form of braking for the cars.

BRIEF SUMMARY OF THE INVENTION

According to the invention, there is provided a toy slot racing vehicle set including a track with one or more slots for electrically-driven toy vehicles guided by a downward projection extending into a slot, the vehicle picking up electrical power from a pair of conductors inset into the track and electrical power supply means for those conductors which include at least one hand-held controller having means to vary the electrical power applied across the conductor so as in turn to vary the speed of the toy vehicle, and further comprising switch means on the hand-held controller for providing a short circuit between the two conductors whereby when the switch means are operated and the two conductors short-circuited, the electrical motor in the vehicle will act in a regenerative sense producing an electrical current which is short-circuited and thereby provides braking for the vehicle.

This arrangement is extremely simple and relies upon the well-known regenerative braking principles of electric motors to provide an actual braking effect to the vehicle's wheels when the electrical motor driving them, instead of being powered by an electrical current, is short-circuited and uses the momentum of the vehicle to produce electrical power. This arrangement can be very simply provided by providing a manually-operable switch on the hand-held controller which, when closed, short-circuits the conductors and which can be actuated from time to time when braking is required.

According to one embodiment of the invention, extra surges of power can be achieved to simulate the effect of a turbo-charged boost as exists for ordinary vehicles.

This can be achieved by including in the powersupply circuit a resistor which normally ensures that a lower voltage than the actual battery or power-supply voltage is applied to the toy vehicle even at apparent full power when the variable resistance has been reduced to zero. Then by providing an appropriate switch or the like, that extra resistance can be temporarily removed from circuit so as to give a sudden boost to raise the supplied voltage above normal to suddenly drive the motor in the vehicle somewhat faster and provide simulation of a turbo-charged boost to a conventional vehicle.

According to a further embodiment of the invention, means are provided to give a steady pre-set output voltage to at least one of the vehicles so that that vehicle will proceed around the track at a steady speed independent of the human operator. This has advantages when there is only one player and that player wishes to race his car against another car. This arrangement can be achieved by a switch arrangement which disables the manual hand-held controller for that track, and instead simply supplies an adjustable but pre-set constant voltage to the conductors for that track. The adjustable pre-set voltage can be achieved by means of a manually adjustable rheostat across the normal power supply so that the user can pre-set the constant speed for the automatically-driven vehicle.

BRIEF SUMMARY OF THE DRAWINGS

An example of the toy slot racing car set according to the invention will now be described, with reference to the accompanying drawings, in which.

DESCRIPTION OF THE PREFERRED EMBODIMENT

Figure 1:
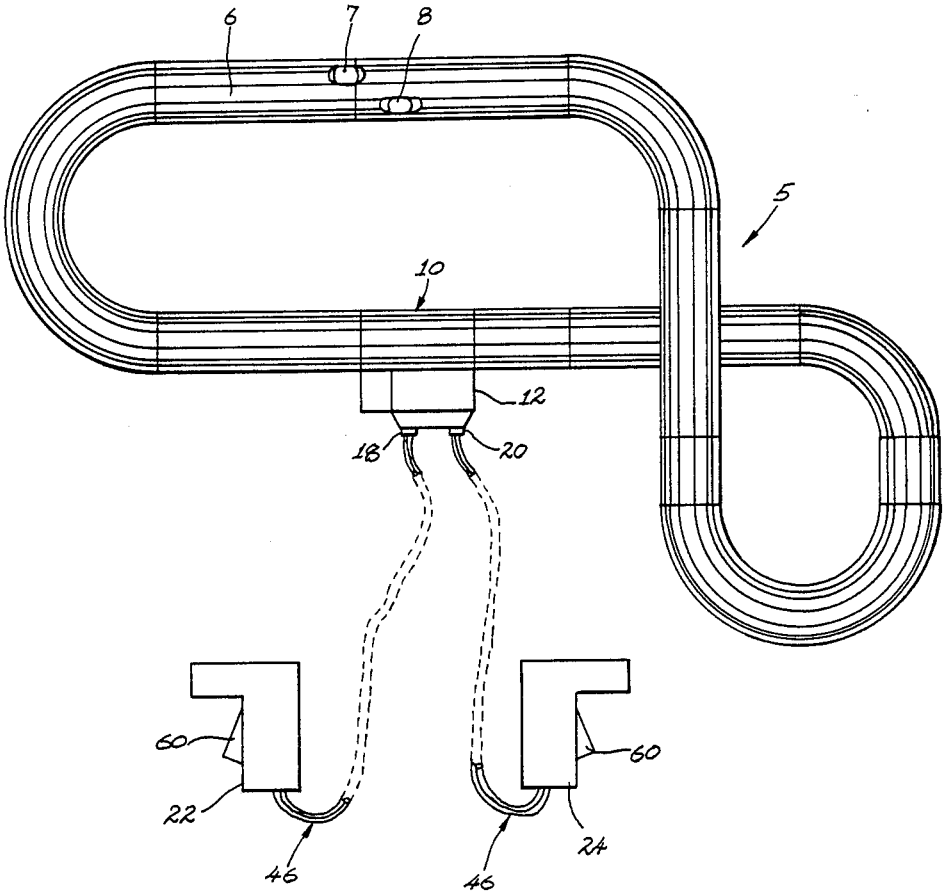
FIG. 1 is a diagram of the track and controllers.
Figure 2:
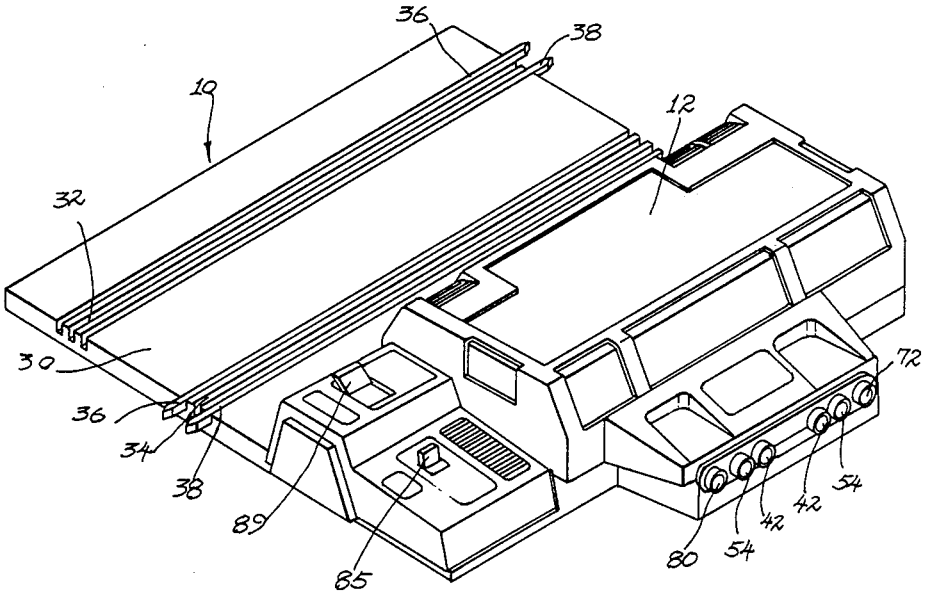
FIG. 2 is a prespective view of a section of track and associated battery box.

The toy slot car racing sets shown in the drawings includes continuous track circuit 6 made up of a number of sections. On the track two cars 7 and 8 are arranged to run. One section 10 of track has integrally formed with it a battery box 12 and four batteries 14 are shown in outline. Connected to the track by means of connectors 18 and 20 are two hand-held controllers 22 and 24 respectively. Each of these controllers is identical but only one controller 22 is shown in detail in FIG. 3.

The section 10 of track is largely conventional as regards toy racing car sets. It comprises a substantially flat base 30 on which the cars 7 and 8 run having a pair of parallel elongated slots 32 and 34. As is conventional with such sets, the cars 7 and 8 have downwardly projecting pins which engage in these slots 32 and 34 to guide them around the track.

On either side of the respective slots 32 and 34 are inset flush with the surface of the track 30 pairs of electrical conductors 36 and 38. As is again conventional, each toy car has a pair of downwardly extending brushes which make contact with these conductors 36 and 38 and so pick up current to drive the electrical motors in the toy vehicles. All of this is entirely conventional with conventional toy slot racing cars and it is not believed further description is necessary.

One of the two conductors in each pair, namely, conductor 36, is regarded as earthed and the two conductors 36 are joined by means of an earth or neutral line 40 which is joined to a neutral contact 50 in the battery box. Further it will be noted that this neutral contact line 40 also joins to a connector 42 in each connector 18 or 20 and in turn is joined to the electric wire 44 in the three parallel wire lead 46 which link the respective hand-held controllers 22 and 24 to the section 10.

The positive contact 42 of the battery box is linked by means of a branched conductor 52 to another connector 54 in each of the respective connectors 18 and 20. In turn, that connector 54 is linked to the central, positive wire 56 of the lead 46.

Figure 3:
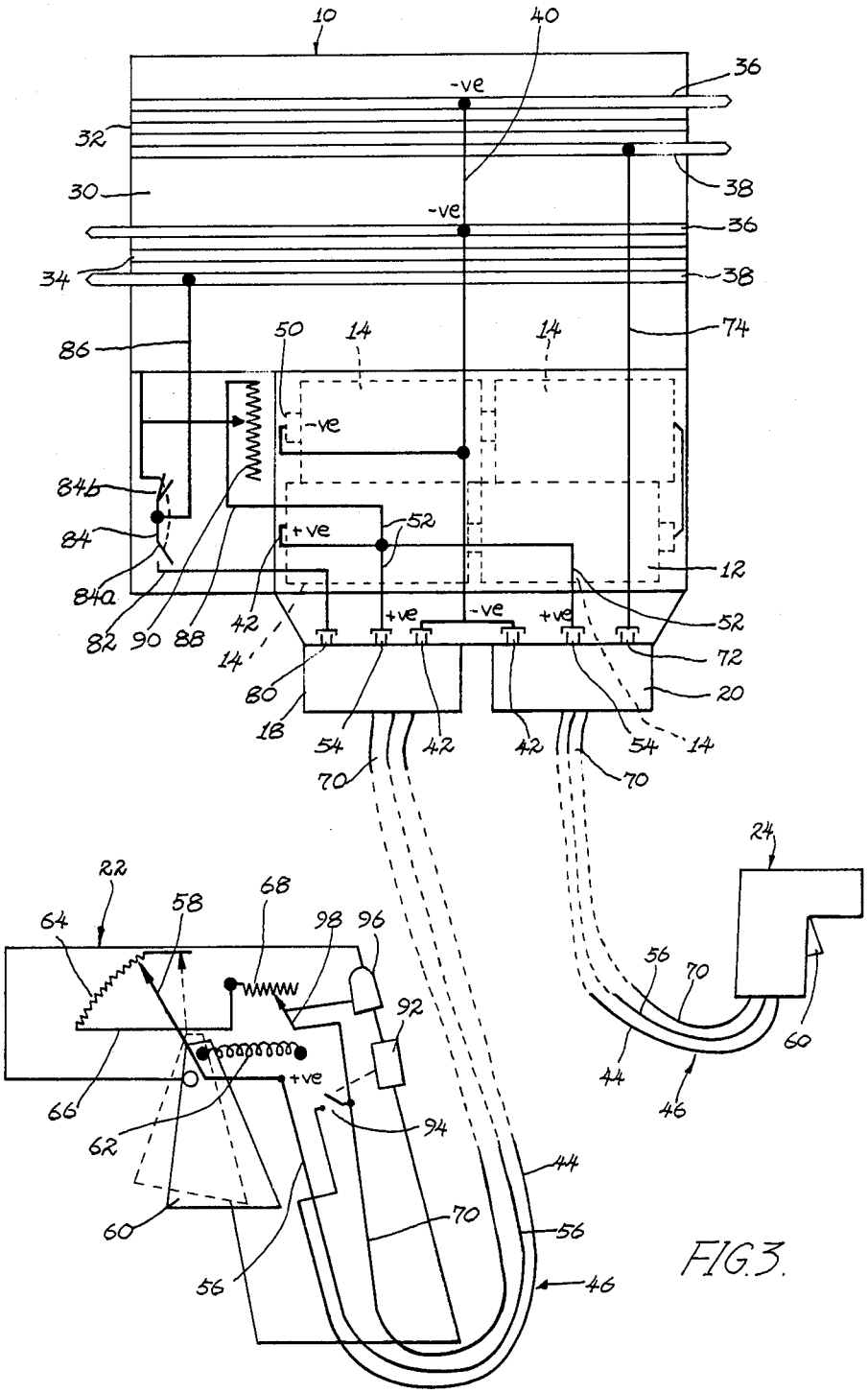
FIG. 3 is a diagram showing a portion of the track, the electrical controls and the electrical circuit.

Turning now to the hand-held controller 22 as shown in FIG. 3, it will be seen that the positive wire 56 is connected to a moveable wiper 58 controlled by means of a manually operable lever 60. The latter is biased by means of a spring 62 to a position shown in dotted lines where it will be seen that the moveable arm 58 makes no contact whatsoever. However, as soon as the lever is depressed somewhat against the action of the spring 62, the moveable wiper 58 comes into contact with one end of a variable electrical resistor 64. The harder the lever 60 is pressed, the further along the resistor 64 does the moveable arm 58 makes contact and so, progressively as the lever is depressed, the resistance of the resistor 64 is progressively reduced.

The other end of the resistor 64 is joined by means of a conductive-link 66 which extends through another resistor 68, whose purpose will be described below, to a power line 70 forming the third wire of the lead 46.

This third line 70 is also joined by the respective connector 18 or 22 to the track 10. In the case of the connector 20, the line 70 is joined by means of the connector 72 and a conductor 74 to the electrical conductor 38 alongside the slot 32. In this way, a variable voltage can be applied to the conductor 38 to provide a variable power supply for the car guided by the slot 32 and the variable voltage is dependent upon the position of the manually-operated lever 60. When the lever is not depressed at all, the variable wiper 58 makes no contact and so no output voltage is supplied but, as it is progressively depressed, a larger and larger voltage is applied to the electrical conductor 38 and this drives the car faster and faster.

The situation for the hand-held controller 22 is slightly different as regards the output from the line 70. In this case, the connector 18 includes a connector 80 which joins to an electrical conductor 82 leading to a two-position switch 84, having parts **84*a* and 84*b*. The latter is manually-controlled by a lever 85 and it is possible for the part 84*a* to be closed or the part 84*b* to be closed. It is not possible for them both to be closed at the same time. In the event that the part 84*a* is closed, then the output from the line 70 is connected directly by means of a conductor 86 to the conductor 38 alongside the slot 34. Thus, in this condition, the hand-held controller 22 operates exactly as has been described in connection with the controller 24**.

As an alternative, however, if the part **84*b* is closed, then the open part 84*a* completely disconnects the line 70 from the hand-held controller 22 and that controller then becomes inoperative for controlling the car passing along the slot 34. Instead, the power supplied to the conductor 38 along the conductor 86 is derived directly from the battery supply positive contact 42. This is achieved by means of a conductor 88 leading to a variable resistor 90 whose value can be manually pre-set by means of a sliding button 89 and the output from that variable resistor passes through the now closed part 84*b* and conductor 86 to the conductor 38. In this way, a manually pre-set but constant voltage can be applied to the conductor 38 and so the vehicle guided by the slot 34 will then receive a constant driving voltage and will travel at a constant speed. It is therefore possible for the user to race against that constant speed car controlling a car guided by the slot 32 by means of the hand-held controller 24**.

In order to provide braking for cars when they are under manual control, a resilient manually depressable push button 92 is provided on each hand-held controller 22 or 24. This button controls an electrical switch 94. The latter is normally open and therefore inoperative. However, when the push button 92 is depressed, the switch 94 is closed and this has the effect of providing a short circuit between the line 70 which is connected to the respective conductor 38 and the wire 44 which is connected to the respective conductor 36. It will be noted that at the same time the user will generally have released the control lever 60 and so the variable wiper 58 will be in a position where it does not contact the resistor 64 and so there will be no particular voltage applied at the output from the variable resistor 68. In this way, by providing a short circuit across the two conductors 36 and 38, the momentum of the car will drive the motor which will in turn cause the motor to act as a dynamo and, because it will be short-circuited, the motor will have the effect of strongly braking the driving wheels of the vehicle.

As explained above, under normal circumstances, the variable resistor 68 will be in circuit. Therefore, even when the lever 60 is depressed to its maximum extent and the resistance value of the variable resistor 64 is substantially zero, there will still be included in the circuit between the positive contact 42 and the conductor 38 a resistance equivalent to resistor 68. Therefore the voltage applied to the conductor 38 will be less than the maximum output voltage of the battery supply. In order to give a simulation of a sudden turbo boost, a resiliently mounted, manually operated push button 96 is provided. This controls the wipe arm 98 bearing against the variable resistor 68. By depressing the push button 96 temporarily, therefore, the resistor 68 can be suddenly and largely short-circuited which provides to the conductor 38 a sudden increase in voltage which will drive the electric motor of the associated car with a sudden surge of power simulating a turbo boost in a conventional car.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A toy slot racing vehicle set including a track, at least one slot for guiding an electrically-driven toy vehicle around said track, at least one vehicle having a downward projection extending into said slot and an electric motor for powering said vehicle around said track, a pair of conductors inset into the track, means on said vehicle for picking up electrical power from said conductors, electrical power supply means for those conductors, said means including at least one hand-held controller having means to vary the electrical power applied across the conductors so as in turn to vary the speed of the toy vehicle, and switch means on said hand-held controller for providing a short circuit between said two conductors, whereby when said switch means are operated and the two conductors short-circuited, said electrical motor in said vehicle will act in a regenerative sense producing an electrical current which is short-circuited and thereby provides braking for said vehicle.

2. A set according to claim 1 in which said switch means comprises a manually-operable switch which, when closed, short-circuits said conductors and which can be actuated from time to time when braking is required.

3. A set according to claim 1 and further comprising a resistor included in said power-supply means to ensure that a lower voltage than the actual battery or power-supply voltage is applied to the toy vehicle even at apparent full power, and a manually operable switch on said hand-held controller to temporarily remove said resistor from circuit so as to give a sudden boost to the voltage supplied to the vehicle to simulate the effect of a turbo-charged boost as exists for ordinary vehicles.

4. A set according to claim 1 in which there are at least two tracks and at least two vehicles and further comprising means to provide a steady pre-set output voltage to one of said vehicles so that that vehicle will proceed around the track at a steady speed independent of a human operator.

5. A set according to claim 4 further comprising a switch arrangement to disable the manual hand-held controller for that track and instead supply an adjustable but pre-set constant voltage to the conductors for that track, the adjustable pre-set voltage being achieved by means of a manually adjustable rheostat across the power supply.

* * * * *